US011542057B2

(12) United States Patent
Couture et al.

(10) Patent No.: US 11,542,057 B2
(45) Date of Patent: Jan. 3, 2023

(54) RETAIL READY PACKAGING FOR CARDED ITEMS

(71) Applicant: West Rock Shared Services, LLC, Atlanta, GA (US)

(72) Inventors: David G. Couture, Hoschton, GA (US); Jesus A. Padilla, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 167 days.

(21) Appl. No.: 16/818,749

(22) Filed: Mar. 13, 2020

(65) Prior Publication Data

US 2021/0284384 A1 Sep. 16, 2021

(51) Int. Cl.

| | |
|---|---|
| ***B65D 5/54*** | (2006.01) |
| ***B65D 5/02*** | (2006.01) |
| ***B65D 5/50*** | (2006.01) |
| ***B65D 73/00*** | (2006.01) |

(52) U.S. Cl.

CPC ..... *B65D 5/5445* (2013.01); *B65D 5/0227* (2013.01); *B65D 5/5007* (2013.01); *B65D 73/0014* (2013.01)

(58) Field of Classification Search

CPC .. B65D 5/5445; B65D 5/0227; B65D 5/5007; B65D 5/4802; B65D 5/5019; B65D 73/0014

USPC .... 206/485, 486, 490, 756, 765, 774, 45.28, 206/45.29, 461, 471

See application file for complete search history.

(56) References Cited

U.S. PATENT DOCUMENTS

| | | | | | |
|---|---|---|---|---|---|
| 4,784,268 | A * | 11/1988 | Perchak | B65D 75/36 | 206/461 |
| 4,930,627 | A * | 6/1990 | Borst | B65D 75/366 | 206/45.23 |
| 6,073,833 | A * | 6/2000 | Desrosiers | B65D 5/5445 | 229/235 |
| 6,401,932 | B1 * | 6/2002 | Weinstein | B65D 25/24 | 206/320 |
| 2003/0024848 | A1 * | 2/2003 | Oycke | B65D 5/5021 | 206/526 |
| 2013/0180883 | A1 * | 7/2013 | Yamamoto | B65D 5/5266 | 206/744 |
| 2019/0382158 | A1 * | 12/2019 | Bojie | B65D 5/5014 | |

* cited by examiner

*Primary Examiner* — Luan K Bui
(74) *Attorney, Agent, or Firm* — Rohini K. Garg

(57) ABSTRACT

A retail ready packaging system includes a convertible carton with a first plurality of slots are defined in a bottom wall adjacent a first side wall, and a second plurality of slots defined in the bottom wall adjacent a second side wall. A plurality of cards are included, wherein each card is seated in one of the slots of the first plurality of slots and in an opposed one of the slots of the second plurality of slots. Each card has a respective foot panel foldably attached to a main panel of the card, wherein the foot panel sits adjacent the bottom wall, and wherein the main panel of the card extends upward from the foot panel toward a top wall of the carton.

9 Claims, 5 Drawing Sheets

Fig. 1
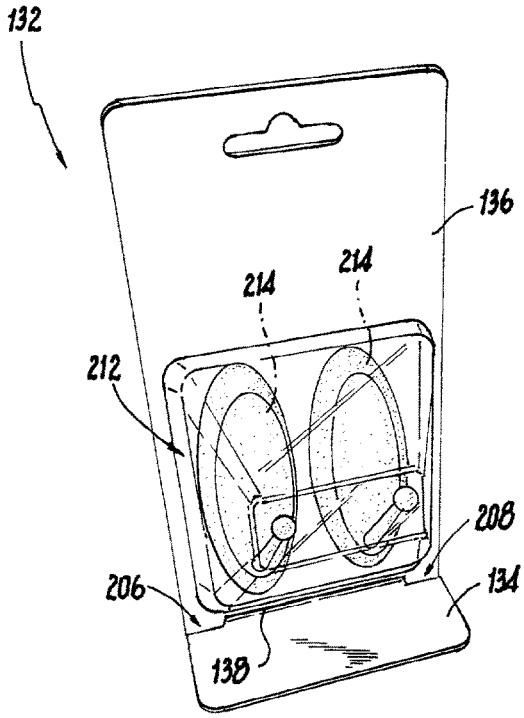
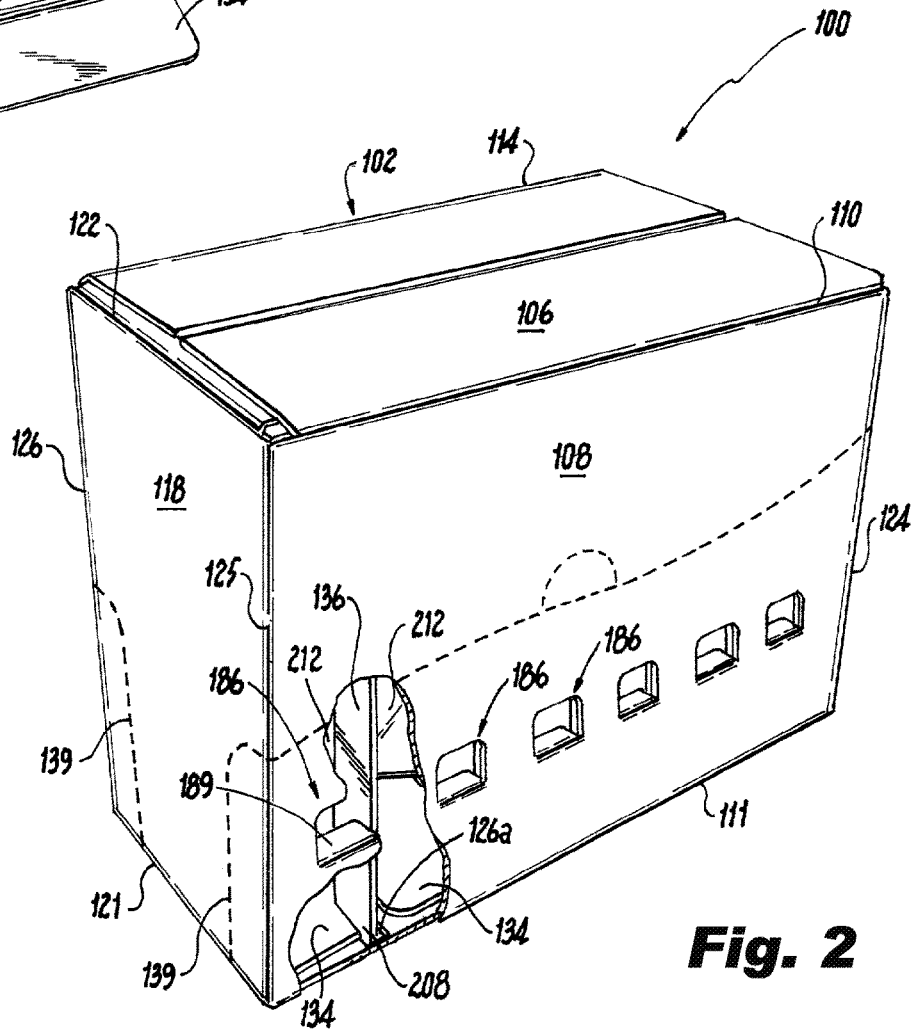
Fig. 2

RETAIL READY PACKAGING FOR CARDED ITEMS

BACKGROUND

1. Field

The present disclosure relates to packaging, and more particularly to retail ready packaging for carded items.

2. Description of Related Art

Typical carded items hang from peg hooks and must be hung one at a time. To avoid the time consuming manual task, retail ready packaging can be used, in which the carded items are displayed from a carton bottom. The cards tend to lean and shift so that the presentation of the cards with in the carton bottom is non-uniform.

The conventional techniques have been considered satisfactory for their intended purpose. However, there is an ever present need for improved systems and methods for retail ready packaging for carded items. This disclosure provides a solution for this need.

SUMMARY

A retail ready packaging system includes a convertible carton with a bottom wall, a top wall opposed to the bottom wall. A first side wall connects between the bottom wall and the top wall. A second side wall is opposed to the first side wall and connects between the bottom wall and the top wall. The carton includes a front wall and a back wall opposed to the front wall, wherein each of the front and back walls connects to the bottom wall, the top wall, the first side wall, and the second side wall. A first plurality of slots are defined in the bottom wall adjacent the first side wall, and a second plurality of slots are defined in the bottom wall adjacent the second side wall. A plurality of cards are included, wherein each card is seated in one of the slots of the first plurality of slots and in an opposed one of the slots of the second plurality of slots. Each card has a respective foot panel foldably attached to a main panel of the card, wherein the foot panel sits adjacent the bottom wall, and wherein the main panel of the card extends upward from the foot panel toward the top wall.

A line of weakness can be defined through the first and second side walls, the back wall, and the front wall for conversion of the convertible carton from a shipping configuration in which the cards are contained within the convertible carton to a retail display configuration in which the cards are exposed for retail display. A respective lunate perforation can be included, connected to the line of weakness in each of the back wall, the first side wall, and the second side wall.

The bottom wall can be defined by a bottom front flap foldably connected to the front wall, a bottom first side flap foldably connected to the first side wall, a bottom second side flap foldably connected to the second side wall, and a bottom back flap foldably connected to the back wall. The first plurality of slots can be defined in the bottom first side flap, and the second plurality of slots are defined in the bottom second side flap. The top wall can be defined by a top front flap foldably connected to the front wall, a top first side flap foldably connected to the first side wall, a top second side flap foldably connected to the second side wall, and a top back flap foldably connected to the back wall. The carton can be formed from a blank, wherein the front wall is defined by a front panel of the blank, the back wall is defined by a back panel of the blank, the first side wall is defined by a first side panel of the blank, and wherein the second side wall is defined by the second side panel.

A plurality of side tabs can be folded inward from the second side wall for engaging the cards to assist the slots in maintaining orientation and spacing of the cards. The side tabs can number one greater than the slots in the first plurality of slots.

A blank for a carded item can include a main panel defining a top edge and two opposed side edges extending from the top edge. A foot panel can be foldably connected to the main panel along a fold line. At each end of the fold line there can be a cut extending inward from the respective one of the side edges. The cuts can each define a foot tab that extends further from the top edge than does the fold line.

A peg hole can be cut out of the main panel for hanging the blank from a peg and hook display. A blister pack containing a product can be affixed to the main panel.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 1 is a perspective view of a carded item constructed in accordance with the present disclosure, showing the foot;

FIG. 2 is a cut-away perspective view of a convertible carton in accordance with this disclosure;

DETAILED DESCRIPTION OF THE PREFERRED EMBODIMENTS

Figure 3:
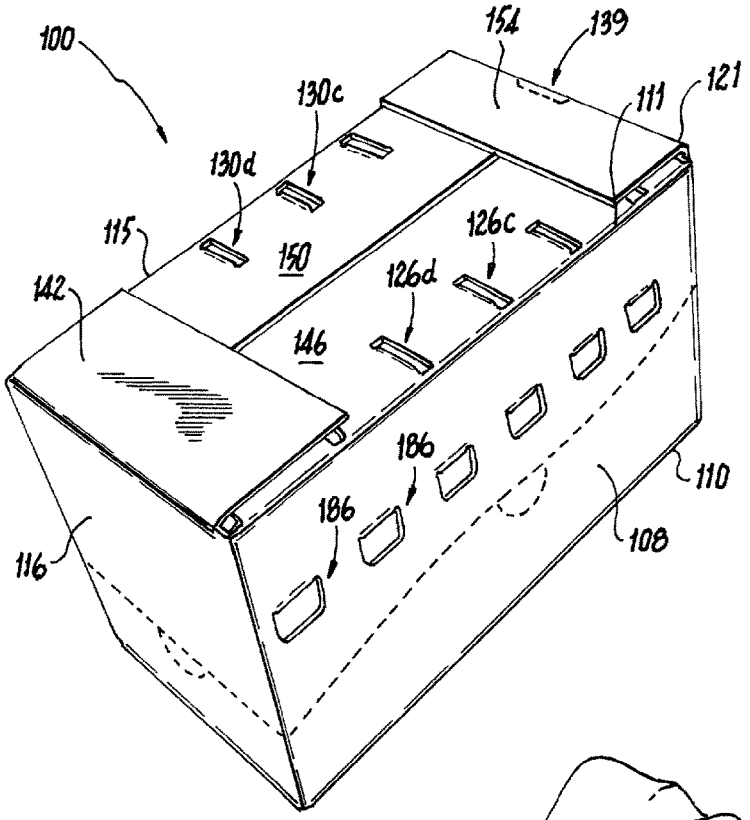
FIG. 3 is a perspective view of the carton of FIG. 2, showing the bottom wall.

Reference will now be made to the drawings wherein like reference numerals identify similar structural features or aspects of the subject disclosure. For purposes of explanation and illustration, and not limitation, a partial view of an embodiment of a retail ready packaging system in accordance with the disclosure is shown in FIG. 2 and is designated generally by reference character 100. Other embodiments of systems in accordance with the disclosure, or aspects thereof, are provided in FIGS. 1 and 3-8, as will be described. The systems and methods described herein can be used to provide for a retail ready package that maintains uniform spacing and orientation of a product within the package, where product items can be displayed from the retail ready package.

Figure 8:
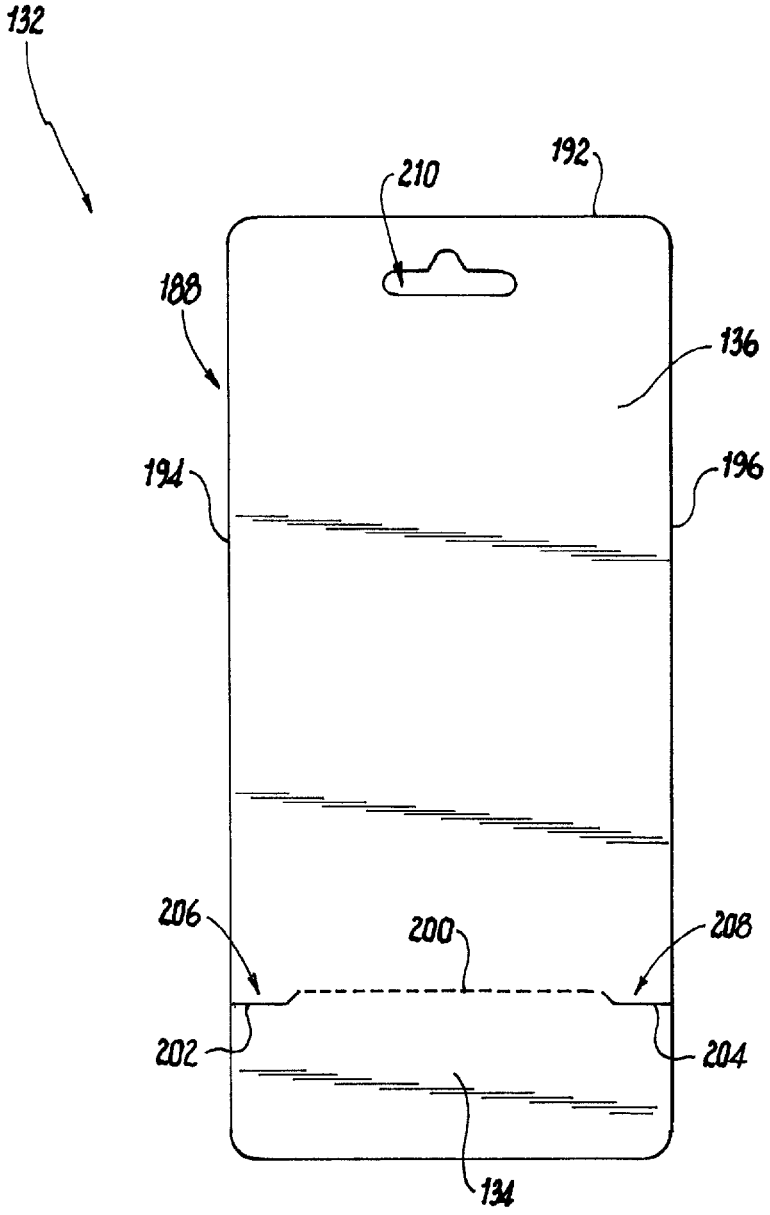
FIG. 8 is a plan view of a blank for forming a card as shown in FIG. 1.

Each card 132 has a respective foot panel 134 foldably attached to a main panel 136 of the card along fold line 138, wherein the foot panel 134 sits adjacent the bottom wall 104, and wherein the main panel 136 of the card extends upward from the foot panel 134 toward the top wall 106. As shown in FIG. 8, a blank 188 for a carded item includes a main panel 136 defining a top edge 192 and two opposed side edges 194, 196 extending from the top edge 192. A foot panel 134 is foldably connected to the main panel 136 along a fold line 200. At each end of the fold line 200 there is a cut 202, 204 extending inward from the respective one of the side edges 194, 196. The cuts 202, 204 each define a foot tab 206, 208 that extends further from the top edge 192 than does the fold line 200. A peg hole 210 is cut out of the main panel 136 for optionally hanging the blank 188 from a peg and hook display. A blister pack 212 containing a product 214 is affixed to the main panel 136, as shown in FIG. 1.

With reference now to FIG. 2, the retail ready packaging system 100 includes a convertible carton 102 with a bottom wall 104, a top wall 106 opposed to the bottom wall. A first side wall 108 connects between the bottom wall 104 and the top wall 106 along fold line 110, 111. A second side wall 112 is opposed to the first side wall 108 and connects between the bottom wall 104 and the top wall 106 along fold lines 114, 115. The carton 102 includes a front wall 116 and a back wall 118 opposed to the front wall 116, wherein each of the front and back walls 116, 118 connects to the bottom wall 104 along fold lines 120, 121, the top wall 106 along fold lines 122, 123, the first side wall 108 along fold lines 124, 125, and the second side wall 112 along fold line 126.

Figure 5:
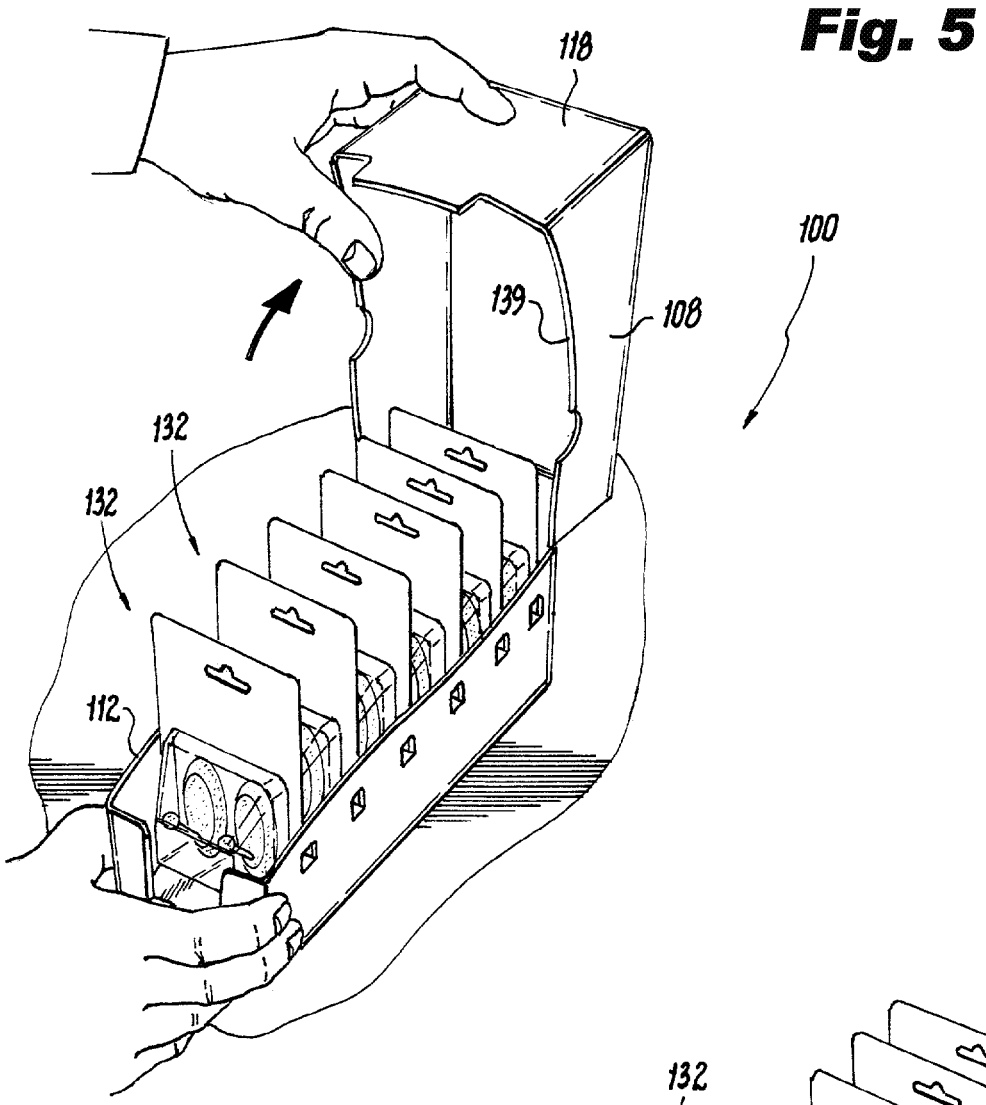
Figure 6:
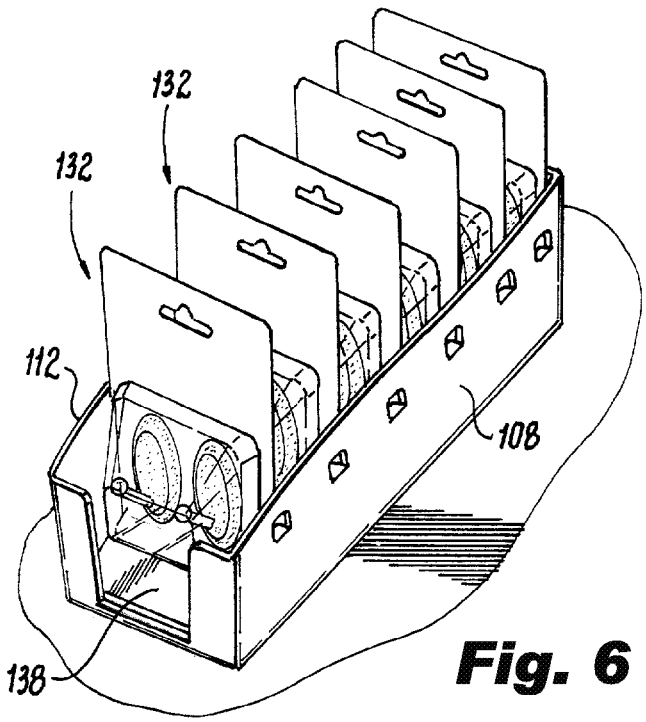
FIG. 6 is a perspective view of a carton of FIG. 2, showing the cards ready for retail after conversion of the carton.

A first plurality of slots 128*a-e* are defined in the bottom wall 104 adjacent the first side wall 108, and a second plurality of slots 130*a-e* are defined in the bottom wall 104 adjacent the second side wall 112. As shown in FIGS. 5-6, a plurality of cards 132 are included, wherein each card 132 is seated in one of the slots 128*a*-128*e* of the first plurality of slots 128*a-e* and in an opposed one of the slots 130*a*-130*e* of the second plurality of slots 130*a-e*. FIG. 2 shows in the cut away one of the cards 132, including the foot 198 and tab 208 when seated inside the carton 102. The foot 198 helps keep the main panel 136 of the card 132 upright, and the tabs 208 engage the slots 128*a-e* and 130*a-e* to help maintain the spacing between the cards 132.

Figure 4:
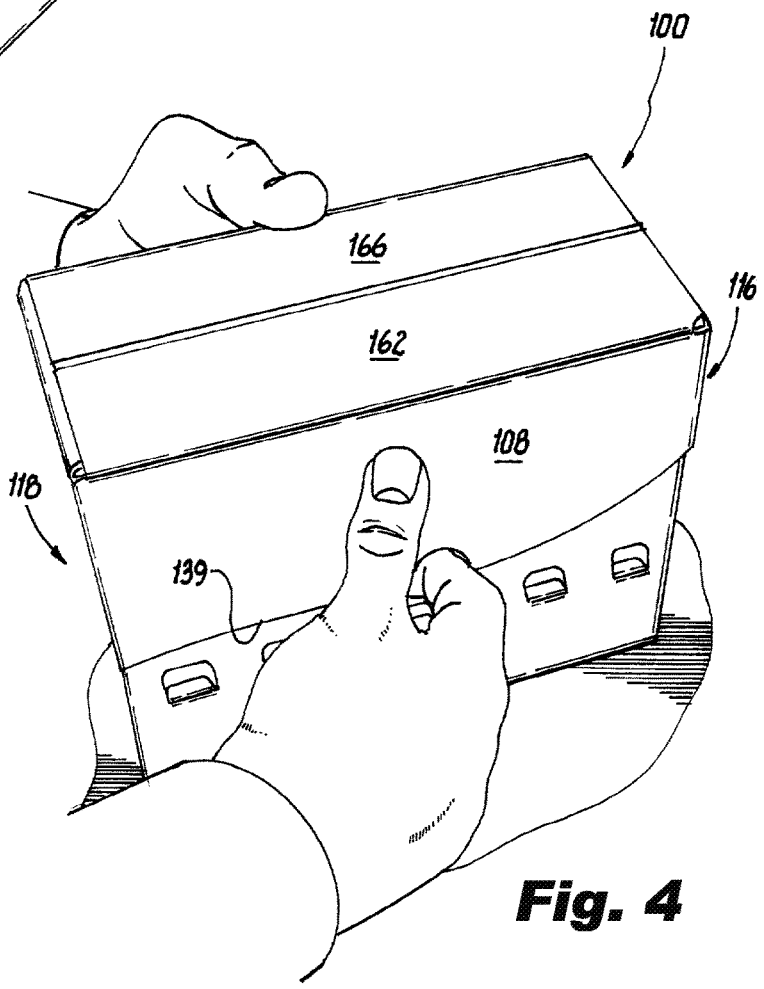
FIGS. 4-5 are perspective views of the carton of FIG. 2, showing the carton during conversion.

As best seen in FIGS. 4 and 5, a line of weakness 139 is defined through the first and second side walls 108, 112, the back wall 118, and the front wall 116 for conversion of the convertible carton 102 from a shipping configuration (e.g. as shown in FIG. 2) in which the cards 132 are contained within the convertible carton 102 to a retail display configuration (e.g. as shown in FIG. 6) in which the cards 132 are exposed for retail display. A respective lunate perforation 140 is included, connected to the line of weakness 139 in each of the back wall 118, the first side wall 108, and the second side wall 112. A user can break the lunate perforations 140, as shown in FIG. 4, then break the top portion 150 of the carton 102 away from the lower portion 152, as shown in FIG. 5, to leave the converted carton 102 as shown in FIG. 6 ready for retail display of the cards 132. The tabs 186 are defined in the bottom portion of the carton 102, i.e. the portion that remains after conversion of the carton 102 as shown in FIG. 6. Those skilled in the art will readily appreciate that the line of weakness 139 can follow any suitable path around the carton 102 without departing from the scope of this invention, including paths that reach the top wall 106 (shown in FIG. 2), e.g. for a full height back wall 116 (labeled in FIG. 7) when the carton 102 is converted.

Figure 7:
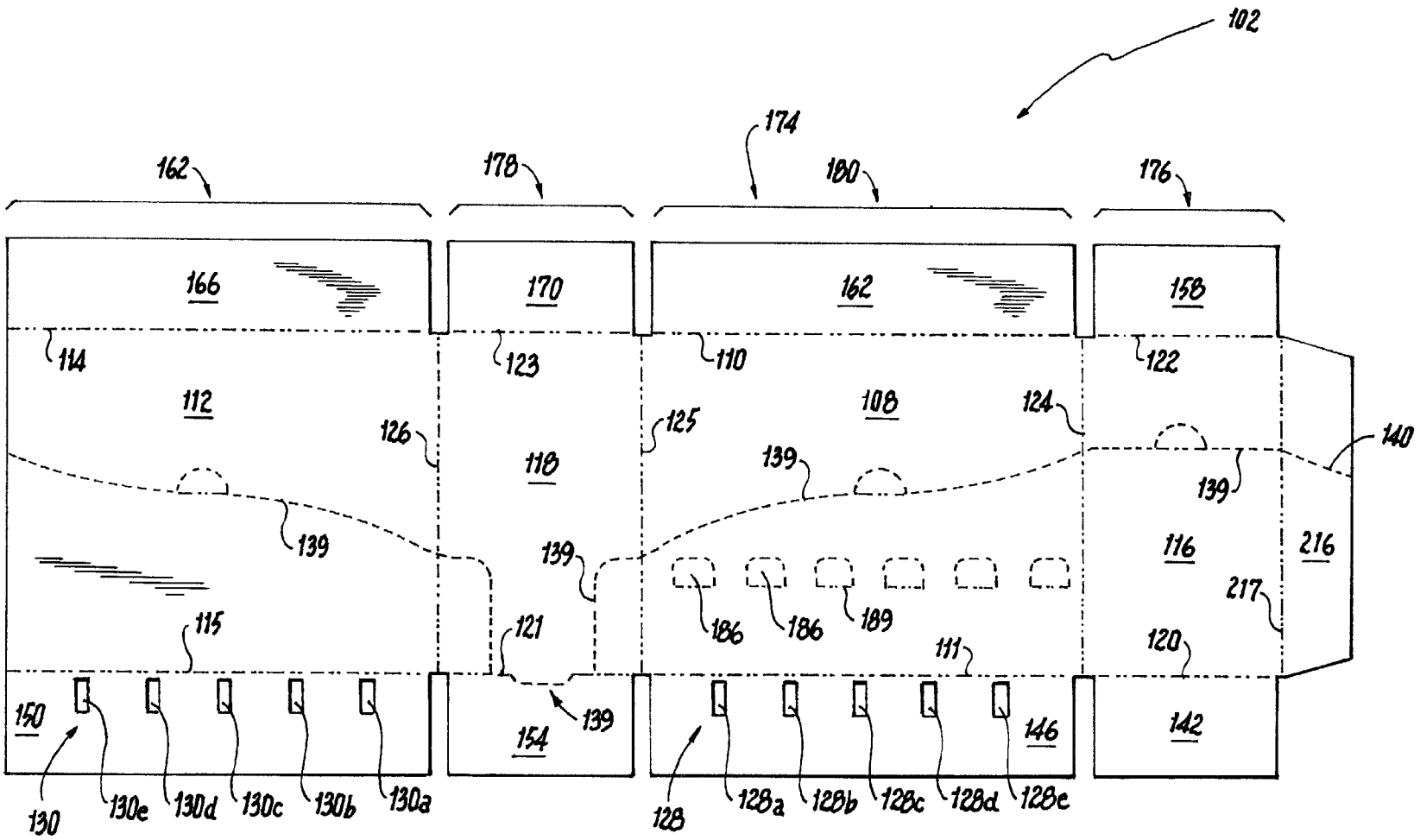
FIG. 7 is a plan view of a blank for forming a carton of FIG. 2.

With reference now to FIG. 7, which shows a plan view of a blank for forming a carton as shown in FIGS. 2-6. The bottom wall 104 is defined by a bottom front flap 142 foldably connected to the front wall 116 along fold line 120, a bottom first side flap 146 foldably connected to the first side wall 108 along fold line 111, a bottom second side flap 150 foldably connected to the second side wall 112 along fold line 115, and a bottom back flap 154 foldably connected to the back wall 118 along fold line 121. The first plurality of slots 128*a-e* are defined in the bottom first side flap 146, and the second plurality of slots 130*a-e* are defined in the bottom second side flap 150. The top wall 106 is defined by a top front flap 158 foldably connected to the front wall 116 along fold line 122, a top first side flap 162 foldably connected to the first side wall 108 along fold line 110, a top second side flap 166 foldably connected to the second side wall 112 along fold line 114, and a top back flap 170 foldably connected to the back wall 118 along fold line 123. The carton 102 is formed from a blank 174, wherein the front wall 116 is defined by a front panel 176 of the blank 174, the back wall 118 is defined by a back panel 178 of the blank 174, the first side wall 108 is defined by a first side panel 180 of the blank 174, and wherein the second side wall 112 is defined by a second side panel 182 of the blank 174.

When erecting the carton 102 the flaps 142, 154 are folded after flaps 146, 150 and can be adhered to the outer surface of the flaps 146, 150. This avoids flaps 142, 154 interfering with the function of the slots 128, 130 at the ends of the carton 102 near the flaps 142, 154. Those skilled in the art will readily appreciate that if slots 128, 130 (and/or tabs 202, 208 of the cards 132) are omitted, the flaps 142, 154, 146, 150 can be in any suitable order.

With continued reference to FIG. 7, a plurality of side tabs 186 are folded inward from the second side wall 112 along fold lines 189 for engaging the cards 132 to assist the slots 128*a-e*, 130 in maintaining orientation and spacing of the cards 132. The side tabs number one greater than the slots in the first plurality of slots (those skilled in the art will readily appreciate that any suitable number of slots 128, 130 and tabs 186 can be used without departing from the scope of this disclosure). The blank 174 can also include a glue tab 216 foldably connected to the front wall 116 along fold line 217 for engaging a portion of the side wall 112. Those skilled in the art will readily appreciate that while tabs 186 are only shown on one side wall 112 of the carton 102, tabs 186 can be included on either sidewall 112, 108, or can be omitted from either or both sidewalls 112, 108 without departing from the scope of this disclosure.

The methods and systems of the present disclosure, as described above and shown in the drawings, provide for a retail ready package that maintains uniform spacing and orientation of a carded product within the package, where product items can be displayed from the retail ready package. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A retail ready packaging system comprising:

a convertible carton with a bottom wall, a top wall opposed to the bottom wall, a first side wall connecting between the bottom wall and the top wall, a second side wall opposed to the first side wall and connecting between the bottom wall and the top wall, a front wall, and a back wall opposed to the front wall, wherein each of the front and back walls connects to the bottom wall, the top wall, the first side wall, and the second side wall; and a plurality of cards, and wherein each card has at least one foot tab extending therefrom, and wherein the card extends upward from the at least one foot tab toward the top wall, wherein each card has a respective foot panel foldably attached to a main panel of the card, wherein the foot panel is positioned proximate to the bottom wall.

2. The system as recited in claim 1, wherein a line of weakness is defined through the first and second side walls, the back wall, and the front wall for conversion of the convertible carton from a shipping configuration in which the cards are contained within the convertible carton to a retail display configuration in which the cards are exposed for retail display.

3. The system as recited in claim 2, wherein a respective lunate perforation is included, connected to the line of weakness in each of the back wall, the first side wall, and the second side wall.

4. The system as recited in claim 1, wherein the bottom wall is defined by a bottom front flap foldably connected to the front wall, a bottom first side flap foldably connected to the first side wall, a bottom second side flap foldably connected to the second side wall, and a bottom back flap foldably connected to the back wall.

5. The system as recited in claim 4, wherein a first plurality of slots are defined in the bottom wall adjacent the first side wall, and a second plurality of slots are defined in the bottom wall adjacent the second side wall, wherein the first plurality of slots are defined in the bottom first side flap, and wherein the second plurality of slots are defined in the bottom second side flap wherein each card is seated in one of the slots of the first plurality of slots and in an opposed one of the slots of the second plurality of slots.

6. The system as recited in claim 1, wherein the top wall is defined by a top front flap foldably connected to the front wall, a top first side flap foldably connected to the first side wall, a top second side flap foldably connected to the second side wall, and a top back flap foldably connected to the back wall.

7. The system as recited in claim 5, further comprising a plurality of side tabs folded inward from the first and the second side walls for engaging the cards to assist the first and the second plurality of slots in maintaining orientation and spacing of the cards.

8. The system as recited in claim 7, wherein a number of the plurality of side tabs is greater than a number of slots in the first plurality of slots.

9. The system as recited in claim 1, wherein the carton is formed from a blank, wherein the front wall is defined by a front panel of the blank, the back wall is defined by a back panel of the blank, the first side wall is defined by a first side panel of the blank, and wherein the second side wall is defined by the second side panel.

* * * * *